US007992398B2

(12) United States Patent
Tiranno et al.

(10) Patent No.: US 7,992,398 B2
(45) Date of Patent: Aug. 9, 2011

(54) REFRIGERATION CONTROL SYSTEM

(75) Inventors: Charles John Tiranno, Wadsworth, OH (US); Mark Edward Anglin, Wadsworth, OH (US); Christopher Edward Kikta, Pittsburgh, PA (US)

(73) Assignee: Honeywell International Inc., Morristown, NJ (US)

( * ) Notice: Subject to any disclaimer, the term of this patent is extended or adjusted under 35 U.S.C. 154(b) by 408 days.

(21) Appl. No.: 12/174,129

(22) Filed: Jul. 16, 2008

(65) Prior Publication Data

US 2010/0011793 A1 Jan. 21, 2010

(51) Int. Cl.
*F25B 41/04* (2006.01)

(52) U.S. Cl. ..... 62/225; 62/204; 62/222

(58) Field of Classification Search ..... 62/225, 62/203, 175, 199, 200, 204, 217, 222; 700/300
See application file for complete search history.

(56) References Cited

U.S. PATENT DOCUMENTS

| | | | | |
|---|---|---|---|---|
| 3,688,516 | A * | 9/1972 | Newton | 62/205 |
| 4,067,203 | A | 1/1978 | Behr | |
| 4,467,613 | A | 8/1984 | Behr et al. | |
| RE33,620 | E | 6/1991 | Persem | |
| 5,533,347 | A | 7/1996 | Ott et al. | |
| 5,782,103 | A | 7/1998 | Schmidt | |
| 5,867,995 | A | 2/1999 | Lewis | |
| 6,360,553 | B1 | 3/2002 | Singh et al. | |
| RE37,630 | E * | 4/2002 | Behr | 62/80 |
| 6,449,968 | B1 | 9/2002 | Singh et al. | |
| 6,578,374 | B2 | 6/2003 | Singh et al. | |
| 6,601,398 | B2 | 8/2003 | Singh et al. | |
| 6,854,285 | B2 | 2/2005 | Jessen | |
| 6,983,618 | B2 | 1/2006 | Singh et al. | |
| 7,134,294 | B2 | 11/2006 | Singh et al. | |
| 2005/0210899 | A1 * | 9/2005 | Maier et al. | 62/216 |
| 2007/0022767 | A1 | 2/2007 | Singh et al. | |

* cited by examiner

*Primary Examiner* — Chen-Wen Jiang
(74) *Attorney, Agent, or Firm* — Seager, Tufte & Wickhem LLC

(57) ABSTRACT

A control apparatus and associated method for a refrigeration system are provided. The control apparatus includes sensors capable of detecting controlled refrigerator zone temperatures and superheat levels of refrigerant vapour exiting an evaporator. The control module receives input from the sensors, compares the input to a determined controlled refrigerator zone set point and a learned superheat level, and generates an output with respect thereto. In particular the output modulates an electronic evaporator pressure regulating (EEPR) valve between an open and a closed position in response to detecting abnormal operation of the thermostatic expansion valve or electronic expansion valve.

16 Claims, 3 Drawing Sheets

REFRIGERATION CONTROL SYSTEM

FIELD OF THE INVENTION

This invention relates to a refrigeration system. In particular, the invention provides a refrigeration system that includes a control system for controlling one or more components of the refrigeration system.

BACKGROUND OF THE INVENTION

Generally, a refrigeration system includes a compressor, a condenser, an expansion valve, and an evaporator. Refrigerant vapor is compressed to a high pressure by the compressor and is conducted through the condenser where it is cooled to form a liquid under high pressure. This high pressure liquid is then adiabatically expanded through the expansion valve into the evaporator. In the evaporator, the refrigerant absorbs heat from the surroundings of the evaporator, which transforms the low pressure liquid refrigerant into a vapor. In this process, the environment surrounding the evaporator, for example, a refrigerator case, is cooled. The refrigerant vapor is then returned to the compressor via a suction line.

Generally, it is desirable to control the amount of liquid refrigerant returning to the inlet of the compressor from the evaporator. In some cases, liquid refrigerant may dilute the lubricating oil in a typical hermetic compressor and thus cause damage to the compressor. Also, liquid refrigerant may damage certain of the compressor components, such as the compressor reed valves.

Another concern with many refrigeration systems is the presence of ice on the evaporator coils. During normal operation of many refrigeration systems, the evaporators may operate at temperatures low enough for water vapor to crystallize on the evaporator coils. This can produce a "frost" on the coils, which may reduce the efficiency of the refrigeration system and may result in liquid refrigerant flooding the compressor. As a result, the surfaces of the evaporator coils must periodically be defrosted.

Various techniques for defrosting refrigeration systems are known. For example, one method for defrosting refrigeration systems is to reverse the refrigeration cycle. When the refrigeration cycle is reversed, hot refrigerant vapor from the compressor is directed into the evaporator outlet, through the evaporator, into the condenser inlet, through the condenser, and back into the compressor. A problem with this method is that often the temperature of refrigerant entering the compressor is so low that some liquid is introduced into the compressor. As discussed above, the presence of liquid in the compressor may damage or destroy the compressor. In addition, the temperature of the refrigerant entering the evaporator may be too low for rapid or complete defrosting of the evaporator. Thus, the defrost cycle may be very time consuming or the evaporator may not be completely defrosted.

As such, there is a need for improved refrigeration systems, in particular, for refrigeration systems in which the amount of liquid refrigerant entering the compressor is controlled and/or in which the amount of ice build up on the evaporator coils is controlled.

SUMMARY

The refrigeration system described herein provides a method and system for controlling the amount of liquid refrigerant entering the compressor and/or icing of evaporator coils. In particular, the refrigeration control system includes one or more microprocessor based controls.

One embodiment of the refrigeration system includes a control apparatus for a refrigeration system having one or more evaporators, each having an inlet and an outlet; one or more controlled refrigerator zones operably associated with one or more evaporators; one or more controlled refrigeration zone sensors operably associated with one or more controlled refrigerator zones and capable of detecting one or more controlled refrigerator zone temperatures; one or more evaporator outlet temperature sensors; an electronic evaporator pressure regulating (EEPR) valve disposed along a suction line of the refrigeration system and having an open and a closed position and capable of modulating between said open and said closed position; one or more refrigerant pressure sensors capable of detecting pressure in the suction line of the refrigeration system; and a control module capable of receiving input from said sensors and operable to learn a baseline superheat during normal operation, compute an amount of superheat, and take control action on the EEPR valve when the superheat deviates from normal operation.

A second embodiment includes method of operating a control module associated with a refrigeration system. The method includes calculating a superheat level and monitoring a controlled refrigeration zone temperature of the refrigeration system; comparing said superheat level with a learned superheat level and comparing said controlled refrigeration zone temperature with a controlled refrigeration zone temperature set point; determining whether said superheat level is below said learned superheat level; determining whether said controlled refrigeration zone temperature is within an activating range; and transmitting a signal to close an electronic evaporator pressure regulating (EEPR) valve an appropriate amount in response to a superheat level below said learned superheat level and a controlled refrigeration zone temperature within said activating range.

The above summary of the present invention is not intended to describe each discussed embodiment of the present invention. This is the purpose of the figures and the detailed description that follows.

DRAWINGS

The invention may be more completely understood in connection with the following drawings, in which.

While the invention is susceptible to various modifications and alternative forms, specifics thereof have been shown by way of example and drawings, and will be described in detail. It should be understood, however, that the invention is not limited to the particular embodiments described. On the contrary, the intention is to cover modifications, equivalents, and alternatives falling within the spirit and scope of the invention.

DETAILED DESCRIPTION

The invention relates to a refrigeration system. In particular, the disclosure provides a refrigeration system that may include one or more controllers that can be used to control various components of the refrigeration system. In one embodiment, the refrigeration system can include a controller configured to regulate one or more EEPR (electronic evaporator pressure regulating) valves. For example, it may be desirable to control the one or more EEPR valves to regulate the amount of liquid refrigerant entering the compressor and/or to modulate icing of one or more evaporator coils. The term "refrigeration system" as used herein can refer to many different refrigeration systems, including commercial refrigeration systems, domestic refrigerators, air conditioners and heat pumps.

Overview of a Refrigeration System

Figure 1:
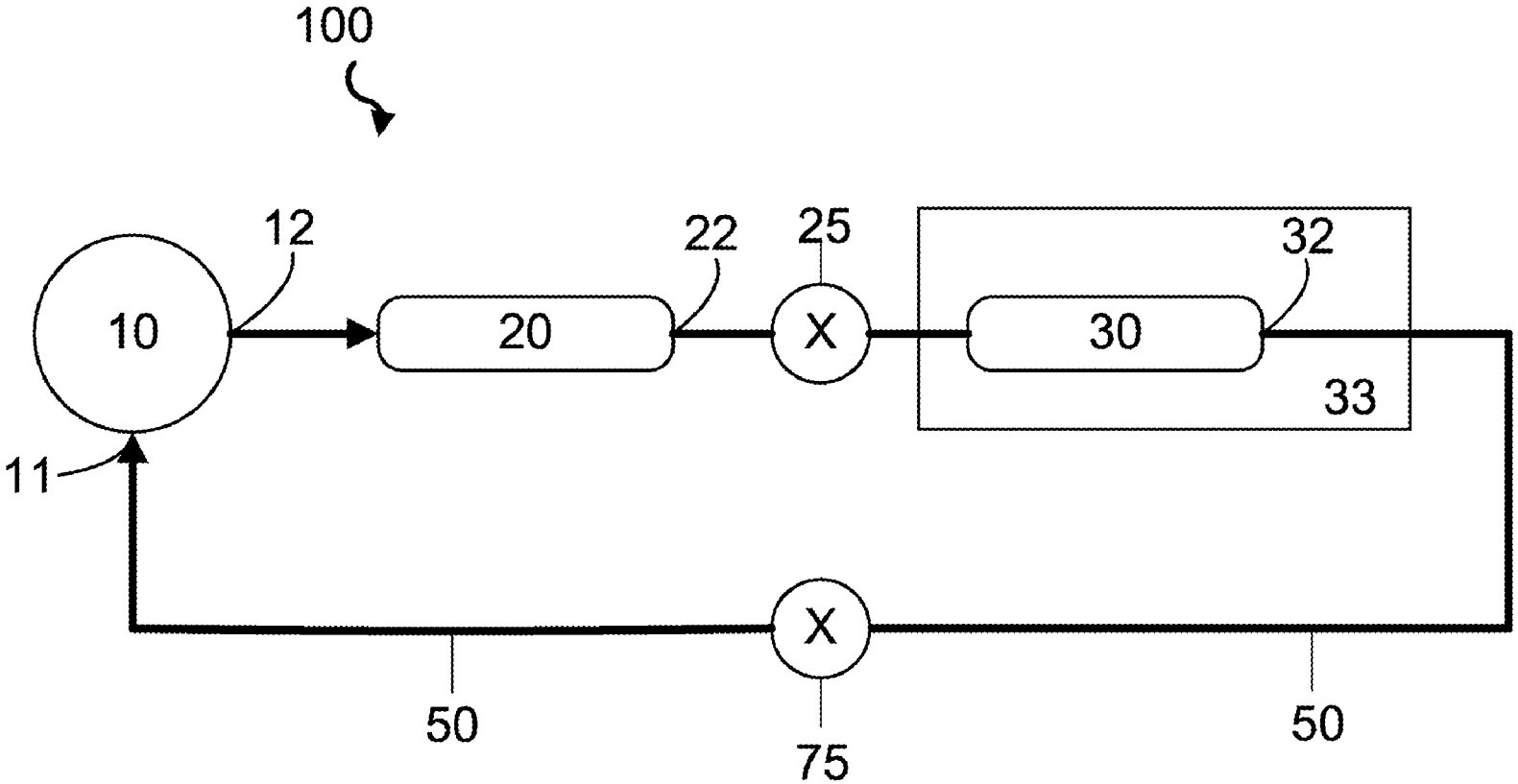
FIG. 1 is a diagrammatic representation of a typical refrigeration system.

A typical refrigeration system will first be described with reference to FIG. 1. The refrigeration system 100 generally includes one or more compressors 10, one or more condensers 20, and one or more evaporators 30. Metering of refrigerant through the one or more evaporators 30 may be carried out by one or more expansion valves 25 and/or one or more electronic evaporator pressure regulating (EEPR) valves 75.

In operation, refrigerant vapor is compressed to a high pressure by the compressor 10 and is conducted through the compressor outlet 12 to one or more condensers 20. In the condenser 20, the refrigerant vapor is condensed to a liquid refrigerant under high pressure. The high pressure liquid refrigerant exits the condenser outlet 22 and is expanded through one or more expansion valves 25 into an evaporator 30 that may include one or more evaporator coils (not shown). Some refrigeration systems include a plurality of parallel evaporators 30. In some systems, each evaporator 30 is associated with an expansion valve 25. In other systems, more than one evaporator 30 can be associated with one expansion valve 25. The refrigerant in the one or more evaporators 30 absorbs heat from the surroundings, which cools the surroundings, referred to herein as a controlled refrigeration zone, and transforms the low pressure liquid refrigerant into a vapor. The refrigerant vapor exits the evaporator 30 through the evaporator outlet 32 and is returned to in inlet 11 of the compressor 10, for example, through a suction line 50.

The term "superheat" as used herein refers to the additional heat (in degrees) that is absorbed by the evaporator coil 30 above the boiling point of the refrigerant in the evaporator coil 30. The boiling point of the refrigerant may vary depending upon the type of refrigerant used and/or the pressure of the refrigerant in the evaporator coil. In some instances, superheat is not directly measured, but rather is calculated as the difference between the saturated suction temperature of the evaporator and the evaporator outlet temperature. The term "saturated suction temperature" refers to the temperature of the vapor line at the suction pressure, for example, as measured by a pressure sensor.

Thermostatic Expansion Valve

Many refrigeration systems 100 include one or more thermostatic expansion valves (TXV) 25. Various configurations of expansion valves 25 are possible and are known to one skilled in the art. Typically, the TXV 25 is configured to maintain a sufficient supply of refrigerant to the evaporator 30 while controlling the amount of liquid refrigerant passing into the suction line 50 and/or compressor 10. For example, the TXV 25 may be configured to meter the flow of liquid refrigerant into the evaporator 30 at a rate corresponding to the amount of refrigerant boiled off in the evaporator 30. Alternately, the TXV 25 may be configured to control the flow of the refrigerant into the evaporator 30 to maintain the superheat of the refrigerant vapor leaving the evaporator 30 at a predetermined level. In some instances, it may be desirable to have the TXV 25 configured to maintain the superheat of the refrigerant exhausted from the evaporator 30 near a preferred or preset superheat setting. In general, a TXV 25 controls the flow rate of refrigerant to the evaporator 30 based on a temperature and/or pressure sensed at an outlet 32 of the evaporator 30 during a refrigeration cycle. Consequently, a TXV 25 typically includes a sensor capable of sensing the temperature and/or pressure of refrigerant exiting the evaporator 30.

In general, opening the TXV 25 increases the amount of refrigerant entering the evaporator 30 and thereby reduces the superheat temperature ($T_{SH}$) of the vapor exhausted from the evaporator 30. Conversely, closing the TXV 25 reduces the flow of refrigerant to the evaporator 30 and therefore typically increases the superheat temperature ($T_{SH}$) of the vapor exhausted from the evaporator 30.

Electronic Evaporator Pressure Regulating Valve

Many refrigeration systems also include one or more electronic evaporator pressure regulating (EEPR) valves 75 interposed on a suction line 50 between one or more evaporators 30 and one or more compressors 10. Generally, the EEPR valve 75 regulates the flow of refrigerant vapor from the evaporator 30 to the compressor 10. Additionally, the EEPR valve 75 may help establish and maintain Suction pressure ($P_S$) relative to the compressor 10, and/or help maintain the superheat temperature ($T_{SH}$) within the evaporator 30.

In general, an EEPR valve 75 includes valve body operably connected to the suction line 50 and a valve element movable within the valve body between a fully closed position and a fully open position, and any position in between. Typically, the position of the valve element is controlled by a motor. Various configurations of EEPR valves 75 are possible and are known to those of skill in the art.

Operation of the EEPR valve 75 may be controlled by a controller 500 that is operably connected to the EEPR valve 75 and is capable of activating the valve motor to open, close or modulate the valve opening. In one embodiment, the controller 500 activates the valve motor in response to a reduction in superheat ($T_{SH}$) temperature of the refrigerant vapor exiting the one or more evaporators 30, combined with an undesirably high temperature in the associated controlled refrigeration zone. In another embodiment, the controller 500 activates the valve motor in response to a reduction in superheat ($T_{SH}$) temperature of the refrigerant vapor exiting the one or more evaporators 30, combined with an undesirably low temperature 35 in the associated controlled refrigeration zone 33. The suction pressure ($P_S$) can be detected by a sensor (for example, at location "B" in FIG. 2) in the refrigeration system 100, and the superheat temperature can be calculated by converting the refrigerant pressure to its associated temperature, and comparing it to the temperature of the refrigerant line as it exists at the outlet of the evaporator 32. Methods for converting a refrigerant pressure to a refrigerant temperature are known to those of skill in the art and include, for example, using calculations based on known equations or looking up the corresponding associated temperature in a table or chart.

Controlled Refrigerator Zone

The refrigeration system 100 may also include one or more controlled refrigerator zones 33 and one or more controlled refrigerator zone temperature sensors 35, wherein each controlled refrigerator zone 33 is associated with at least one evaporator 30 and adapted to be cooled by the evaporator 30. As used herein, the term controlled refrigerator zone 33 refers to the environment that is being cooled by the refrigeration system 100, regardless of encapsulation. The controlled refrigerator zone 33 can take a variety of forms, including, but not limited to, a domestic or commercial refrigerator case, a walk-in freezer, a merchandizing case, or a room being cooled by an air conditioner. In many refrigeration systems 100, the controlled refrigerator zone 33 includes more than one evaporator 30. The controlled refrigerator zone 33 may also include one or more sensors 35 that are operably connected to the controller 500 and are capable of determining the temperature in the controlled refrigerator zone ($T_C$) and sending a signal to the controller 500 regarding the temperature in the controlled refrigerator zone 33. The controller 500 can then compare the temperature in the controlled refrigerator zone ($T_C$) to the desired controlled refrigeration zone temperature setpoint ($T_{CSET}$).

Defrost Cycle

The refrigeration cycle may include a defrost cycle to reduce the presence of ice on the evaporator coils. The frequency with which a particular evaporator must be defrosted can depend on the rate at which ice builds up, the cooling load on the evaporator and the rate at which it can be defrosted. In general, the length of the defrost period is determined by the degree of ice accumulation on the evaporator and by the rate at which heat can be applied to melt off the ice. Ice accumulation can vary with the type of installation, the conditions inside the fixture and the frequency of defrosting.

Initiation of a defrost cycle can be controlled by a timer within the controller or by detection of some parameter other than time. Determining a suitable signal for initiating a defrost cycle is within the skill of one in the art. In any event, when the controller is informed that it is time for defrost, it enters the defrost mode.

Refrigeration Control System

Various embodiments of a refrigeration system 100 will now be described with reference to FIG. 2. As discussed previously, a refrigeration system 100 can include one or more compressors 10, one or more condensers 20, one or more expansion valves 25, one or more evaporators 30, one or more controlled refrigeration zones 33 and/or one or more EEPR valves 75. The refrigeration system 100 may also include a system controller 500 operable to control one or more aspects of the refrigeration system.

Metering of refrigerant through the evaporators 30 can be accomplished by one or more expansion valves 25 and/or one or more EEPR valves 75. In one embodiment, for example that shown in FIG. 2, the refrigeration system 100 includes more than one evaporator 30. In many refrigeration systems 100 having more than one evaporator 30, the evaporators are located in parallel and are positioned on one or more branches 41 stemming from a branch point 40 located downstream of a condenser outlet 22. See for example, FIG. 2. If desired, each evaporator 30 can have an expansion valve 25 associated therewith, wherein the expansion valves 25 are located on the branches 41 downstream of the branch point 40. If desired, each expansion valve 25 can be operated independently or the expansion valves 25 can be operated in concert. In an alternate embodiment (not shown), a single expansion valve 25 can be associated with more than one evaporator 30. In this embodiment, the expansion valve 25 is generally located upstream of the branch point 40 (but downstream of the condenser outlet 22). In other embodiments, a combination in which one or more evaporators 30 is associated with one expansion valve 25 and in which one or more evaporators 30 is associated with its own expansion valve 25 may be desirable.

Figure 2:
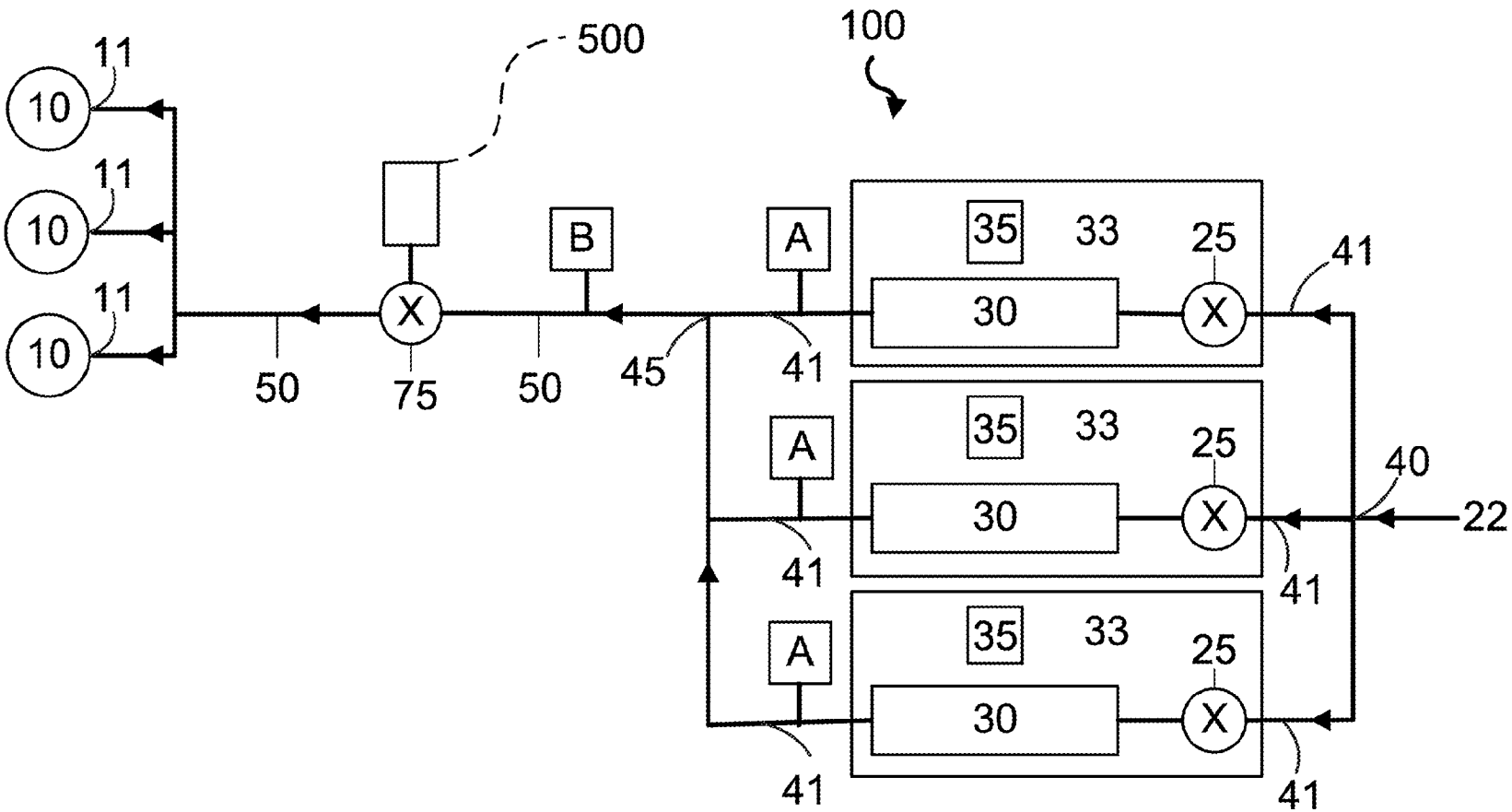
FIG. 2 is a diagrammatic representation of an embodiment of a refrigeration system described herein.

In the embodiment shown in FIG. 2, one EEPR valve 75 is associated with more than one evaporator 30. In this embodiment, the EEPR valve 75 is located downstream of a junction 45 of the evaporator 30 branches 41. In an alternate embodiment (not shown), at least one EEPR valve 75 can be employed for each evaporator 30. Alternately, a combination in which one or more evaporators 30 is associated with one EEPR valve 75 and one or more evaporators 30 is associated with its own EEPR valve 75 may be desirable. If more than one EEPR valve 75 is included in the refrigeration system 100, each EEPR valve 75 can be controlled separately by a separate controller 500. Alternately, one or more EEPR valves 75 can be controlled with a single controller 500.

Sensors

The refrigeration system 100 may include one or more sensors located between one or more evaporators 30 and one or more EEPR valves 75, wherein the sensor is capable of detecting the superheat temperature ($T_{SH}$) of the refrigerant vapor exiting one or more evaporators 30. In one embodiment, a sensor is associated with each evaporator 30 in the refrigeration system 100 (shown as "A" in FIG. 2). In this embodiment, each sensor "A" is located proximate an outlet of its associated evaporator 30. For example, each sensor "A" can be located on the same branch 41 as its associated evaporator 30 upstream of junction 45.

Because the EEPR valve 75 may also help establish and maintain suction pressure ($P_S$) relative to the compressor 10, it may be desirable to include a pressure sensor (shown as "B" in FIG. 2) between the evaporator coil 30 and the EEPR valve 75. The amount of superheat can be determined by reading the pressure sensor B, converting the pressure to the saturated suction temperature for the associated refrigerant (using a calculation or looking up in a table), and subtracting it from the temperature as read at location A.

Control Sequence

In general, the controller 500 maintains the controlled refrigeration zone temperature 35 within a predetermined or desired temperature range ($T_{SET}$) by modulation of one or more EEPR valves 75. Throughout the refrigeration cycle, the controller 500 receives signals from one or more temperature sensors associated with one or more evaporators 30, one or more controlled refrigerator zones, and/or one or more pressure sensors "B". Based on these inputs, the controller 500 modulates the opening of one or more EEPR valves 75.

Figure 3:
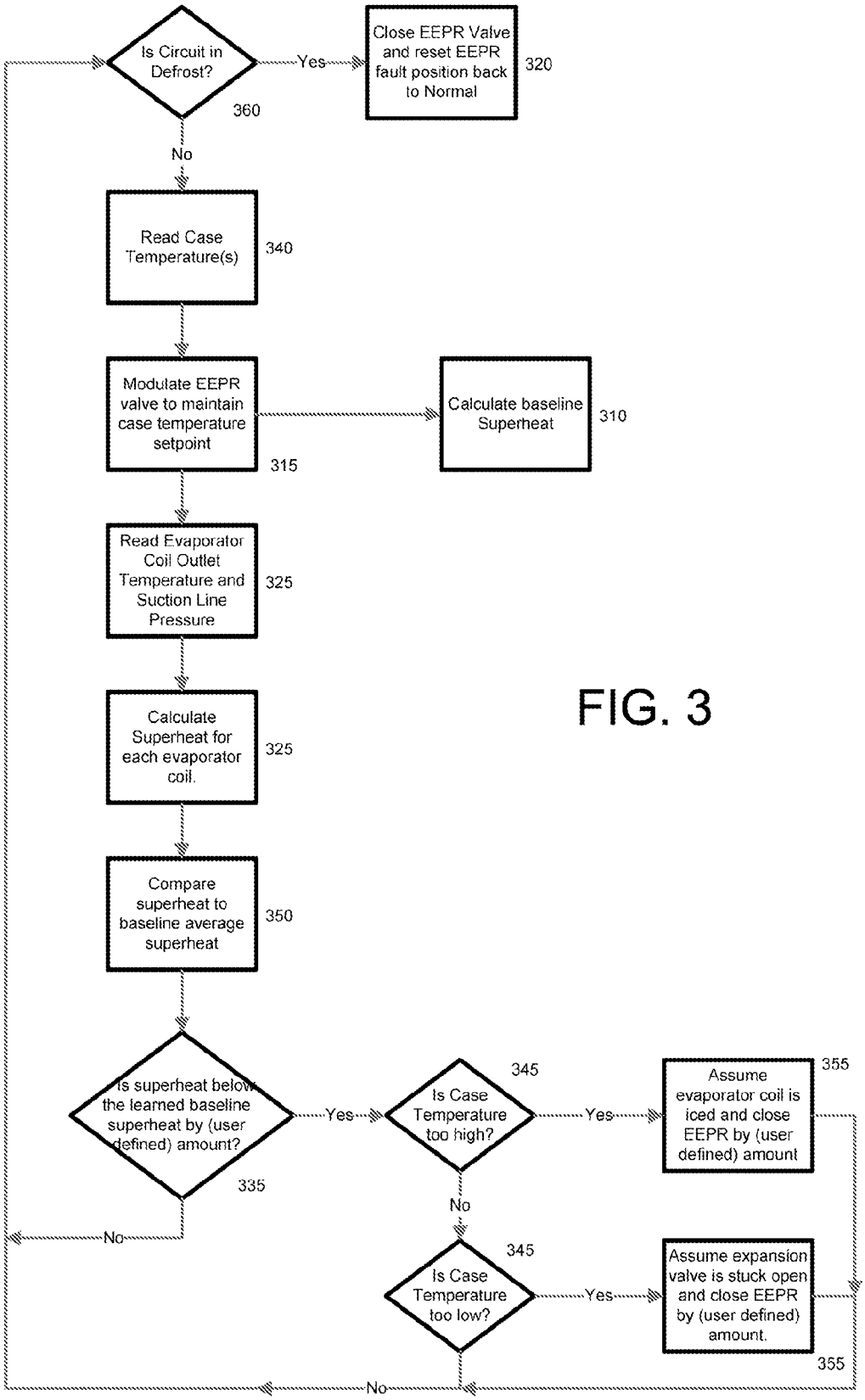
FIG. 3 is a schematic flow chart of controller operation of a refrigeration system as described herein.

One control sequence 300 of the operation of the controller 500 is shown schematically in the flow chart of FIG. 3. At the onset of the refrigeration cycle, the controller 500 is programmed with a preferred or "learned" superheat ($T_{SET}$) level 310. The "learned" superheat ($T_{SET}$) is determined by monitoring the superheat value on a regular basis when the EEPR is in normal operation and weighing it over a period of time into a baseline profile or an average value. The controller 500 is also programmed with a normal temperature "set point" for one or more controlled refrigerator zones ($T_{CSET}$) 315. The temperature set point is product and/or application specific and can be determined by the user. Factors that may be considered in determining a suitable set point include, for example, food type, case type, and case manufacturer. If desired, the set point can be different for different controlled refrigerator zones 33 within a refrigeration system 100. Throughout the refrigeration cycle, the controller 500 receives signals from the one or more temperature sensors 35 associated with the controlled refrigerator zones 33 to determine the actual superheat ($T_{SH}$) level of the system 325. During the refrigeration cycle, the actual superheat ($T_{SH}$) level is compared to the learned superheat ($T_{SET}$) 350.

Throughout the refrigeration cycle, the controller 500 also receives signals from the one or more temperature sensors 35 associated with one or more controlled refrigerator zones 33 to determine the actual controlled refrigerator zone temperature ($T_C$) 340. The actual controlled refrigerator zone temperature ($T_C$) is compared to a controlled refrigeration zone temperature set point ($T_{CSET}$) 345.

If the actual superheat ($T_{SH}$) drops a determined amount below the learned level ($T_{SET}$) 335, and if one or more sensed controlled refrigeration zone temperatures ($T_C$) are below a set point 345 (also referred to herein as a "normal" temperature) by a user specified amount (which may be application specific), the controller 500 transmits a signal to close the respective EEPR valve 75 an appropriate amount 355 to a modified EEPR position. The "determined amount below the learned level" can be defined by the user in the software, and may vary depending on the desired sensitivity of this function. The amount that the valve is closed is application specific and is a user specified parameter in the software for the controller. In this scenario, it is assumed that one or more of the expansion valves 25 are not closing sufficiently. Consequently, closing the EEPR valve 75 helps prevent liquid refrigerant from returning to the one or more compressors 10. This modified EEPR position will remain in effect until the next defrost cycle occurs 360. Upon detecting a defrost cycle, the controller will re-start the control sequence. At the end of a defrost cycle, the EEPR will be in the closed position, and it will begin to modulate open as far as it needs to go to bring the controlled refrigeration zone temperature 35 down to the associated setpoint ($T_{CSET}$).

An alternate control sequence 300 of the operation of the controller 500 is also shown schematically in the flow chart of FIG. 3. Many of the steps in the sequence are the same as described above. However, in this control sequence, if the actual superheat ($T_{SH}$) drops a determined amount below the learned level ($T_{SET}$) 335, and if one or more sensed controlled refrigeration zone temperatures ($T_C$) are a determined amount above a set point 345, the controller 500 transmits a signal to close the EEPR valve 75 by an appropriate amount to a modified EEPR position 355. As discussed above, the determined amount is user and/or application specific. In this scenario, closing the EEPR valve 75 results in an increase in the evaporator coil pressure and thereby helps reduce additional ice build-up on the evaporator coils. The modified EEPR position will be in effect until the next defrost cycle is detected 360. Upon detecting a defrost cycle, the controller will re-start the control sequence. Starting from a closed position, the valve will begin to modulate open as far as it needs to go in order to bring the controlled refrigeration zone temperature down to the setpoint.

It will be understood that the foregoing is only illustrative of the principles of the invention and that various modifications can be made by those skilled in the art without departing from the scope and spirit of the invention. Accordingly, such embodiments will be recognized as within the scope of the present invention. Persons skilled in the art will also appreciate that the present invention can be practiced by other than the described embodiments, which are presented for purposes of illustration rather than of limitation and that the present invention is limited only by the claims that follow.

The invention claimed is:

1. A control apparatus for a refrigeration system comprising:

a. one or more evaporators, each having an inlet and an outlet;

b. one or more controlled refrigerator zones operably associated with said one or more evaporators;

c. one or more controlled refrigerator zone sensors operably associated with one or more controlled refrigerator zones and capable of detecting one or more controlled refrigerator zone temperatures;

d. one or more evaporator outlet temperature sensors;

e. an electronic evaporator pressure regulating (EEPR) valve disposed along a suction line of the refrigeration system and having an open and a closed position and capable of modulating between said open and said closed position;

f. one or more refrigerant pressure sensors capable of detecting pressure in the suction line of the refrigeration system; and g. a control module configured to receive inputs from said one or more controlled refrigerator zone sensors, said one or more evaporator outlet temperature sensors, and said one or more refrigerant pressure sensors, wherein said control module is configured to use one or more of said inputs to learn a baseline superheat during normal operation, compute an actual amount of superheat, and take control action on the EEPR valve in response to the comparison of said baseline superheat and said actual superheat.

2. The control apparatus of claim 1, wherein said one or more evaporators includes more than one evaporator.

3. The control apparatus of claim 2, wherein one EEPR valve is associated with said more than one evaporator.

4. The control apparatus of claim 2, wherein the one or more refrigerant pressure sensors are associated with each of said more than one evaporator.

5. The control apparatus of claim 2, wherein said more than one evaporators are operated on parallel branches and at least one of said one or more evaporator outlet temperature sensors is located between an outlet of said more than one evaporator and a junction of the parallel branches.

6. The control apparatus of claim 1, wherein the one or more refrigerant pressure sensors are disposed on the suction line between said EEPR valve and one or more evaporators.

7. A method of operating a control module associated with a refrigeration system, the method comprising:

a. the control module calculating a superheat level and monitoring a controlled refrigeration zone temperature of the refrigeration system using one or more signals received from one or more sensors;

b. the control module comparing said superheat level with a learned superheat level and comparing said controlled refrigeration zone temperature with a controlled refrigeration zone temperature set point;

c. the control module determining whether said superheat level is below said learned superheat level;

d. the control module determining whether said controlled refrigeration zone temperature is within an activating range; and e. the control module transmitting a signal to close an electronic evaporator pressure regulating (EEPR) valve an appropriate amount in response to the control module determining a superheat level below said learned superheat level and a controlled refrigeration zone temperature within said activating range.

8. The method of claim 7, wherein the control module determines that said controlled refrigeration zone temperature is within said activating range when said controlled refrigeration zone temperature is greater than a controlled refrigeration zone set point temperature.

9. The method of claim 7, wherein the control module determines that said controlled refrigeration zone temperature is within said activating range when said controlled refrigeration zone temperature is less than a controlled refrigeration zone set point temperature.

10. The method of claim 7, further comprising:

the control module monitoring whether the refrigeration system has undergone a defrost cycle and resetting the EEPR valve to normal upon obtaining input that a defrost cycle has occurred.

11. The method of claim 7, wherein said refrigeration system comprises a plurality of evaporators.

12. The method of claim 11, wherein said EEPR valve that the control module transmits a signal to is associated with the plurality of evaporators.

13. The method of claim 7, where said one or more sensors include one or more evaporator outlet temperature sensors interposed on a suction line between one or more evaporators and said EEPR valve.

14. The method of claim 13, wherein said refrigeration system comprises a plurality of evaporators that are operated on parallel branches and said one or more evaporator outlet temperature sensors are located between an outlet of each of said plurality of evaporators and a junction of the parallel branches.

15. The method of claim 7, wherein said one or more sensors include one or more pressure sensors that are positioned between one or more evaporators and said EEPR valve.

16. A control module for a refrigeration system, comprising:

a control output for providing a control signal to an electronic evaporator pressure regulating (EEPR) valve;

a refrigeration zone temperature input for receiving a refrigeration zone temperature from a refrigeration zone temperature sensor of the refrigeration system;

a controller in communication with the control output and the refrigeration zone temperature input;

the controller is programmed to determine a current superheat level of the refrigeration system using the refrigeration zone temperature received via the refrigeration zone temperature input;

the controller is further programmed to determine a learned superheat level by monitoring the current superheat level over a period of time;

the controller is further programmed to compare said current superheat level with the learned superheat level, and to compare the refrigeration zone temperature with a stored refrigeration zone temperature set point;

the controller is further programmed to determine if said current superheat level is below said learned superheat level, and if said refrigeration zone temperature is within an activating range; and the controller is further programmed to provide a control signal to the control output of the control module to adjust the electronic evaporator pressure regulating (EEPR) valve by an appropriate amount in response to the controller determining that the current superheat level is below the learned superheat level, and the refrigeration zone temperature is within said activating range.

* * * * *